US009717942B2

(12) United States Patent
Bastyr

(10) Patent No.: US 9,717,942 B2
(45) Date of Patent: Aug. 1, 2017

(54) EXERCISE DEVICE UTILIZING BODY WEIGHT FOR RESISTANCE

(71) Applicant: Charles Arthur Bastyr, Del Mar, CA (US)

(72) Inventor: Charles Arthur Bastyr, Del Mar, CA (US)

( * ) Notice: Subject to any disclaimer, the term of this patent is extended or adjusted under 35 U.S.C. 154(b) by 0 days.

(21) Appl. No.: 14/623,410

(22) Filed: Feb. 16, 2015

(65) Prior Publication Data

US 2016/0236027 A1 Aug. 18, 2016

Related U.S. Application Data

(60) Provisional application No. 61/940,978, filed on Feb. 18, 2014.

(51) Int. Cl.

| | |
|---|---|
| ***A63B 21/062*** | (2006.01) |
| ***A63B 21/068*** | (2006.01) |
| ***A63B 23/035*** | (2006.01) |
| *A63B 22/00* | (2006.01) |
| *A63B 23/00* | (2006.01) |
| *A63B 21/00* | (2006.01) |
| *A63B 23/04* | (2006.01) |
| *A63B 23/12* | (2006.01) |

(52) U.S. Cl.

CPC ..... *A63B 21/068* (2013.01); *A63B 21/00072* (2013.01); *A63B 21/159* (2013.01); *A63B 21/4034* (2015.10); *A63B 21/4035* (2015.10); *A63B 21/4047* (2015.10); *A63B 23/0355* (2013.01); *A63B 23/03525* (2013.01); *A63B 23/03575* (2013.01); *A63B 21/4009* (2015.10); *A63B 21/4017* (2015.10); *A63B 21/4027* (2015.10); *A63B 22/0002* (2013.01); *A63B 22/0015* (2013.01); *A63B 22/0048* (2013.01); *A63B 23/0405* (2013.01); *A63B 23/1209* (2013.01); *A63B 2022/0035* (2013.01); *A63B 2023/006* (2013.01); *A63B 2208/0233* (2013.01)

(58) Field of Classification Search

CPC ..... A63B 21/068; A63B 21/4009; A63B 21/4017; A63B 21/4047; A63B 22/0002; A63B 22/0015; A63B 22/0048; A63B 2022/035; A63B 2023/006

See application file for complete search history.

(56) References Cited

U.S. PATENT DOCUMENTS 5,643,147 A * 7/1997 Huang ..... A63B 21/068 482/72

5,676,626 A * 10/1997 Huang ..... A63B 23/03575 482/72

(Continued)

*Primary Examiner* — Loan H Thanh
*Assistant Examiner* — Megan Anderson
(74) *Attorney, Agent, or Firm* — MU P.C.

(57) ABSTRACT

An exercise device which includes a first and second lever pivotally attached to a frame and pivotally interconnected by a connecting rod. A first arm is pivotally connected to the frame and a second arm is pivotally connected to the ends of the first arm and the second lever opposite the ends connected to the frame. The second arm includes a seat for the user, whose body weight provides a resistance to rotation of the free end of the first lever. In one embodiment a slide assembly is engaged with the second lever to selectively vary the resistance to rotation of the first lever.

19 Claims, 18 Drawing Sheets

(56) References Cited

U.S. PATENT DOCUMENTS 6,984,196 B2 * 1/2006 Tornabene ..... A63B 21/068
482/140
7,452,311 B2 * 11/2008 Barnes ..... A63B 21/00072
482/137

* cited by examiner

EXERCISE DEVICE UTILIZING BODY WEIGHT FOR RESISTANCE

This application claims the benefit of U.S. Provisional Application No. 61/940,978, filed on Feb. 18, 2014. The contents of U.S. Provisional Application No. 61/940,978 are incorporated herein by reference.

FIELD OF THE INVENTION

The present invention pertains generally to physical exercise devices. More specifically, the present invention pertains to portable exercise devices and methods for using these devices. The present invention is particularly, but not exclusively, useful as an adjustable exercise device which utilizes the user's body weight as the resistive force and which allows the user to selectively adjust the magnitude of the exercise resistance.

BACKGROUND

A wide variety of exercise devices are commercially available for purchase and use by individuals for the purpose of developing their strength and physical condition. In general, exercise equipment can be categorized as being portable or stationary. Portable exercise equipment is typically limited in the number of exercises that can be performed. Often, portable equipment is designed for one specific purpose, such as for exercising a single targeted muscle group, necessitating a separate exercise device for each muscle group that the user wants to strengthen or condition. Also, portable exercise equipment is frequently designed such that the user must get on the floor to use the device.

Alternatively, stationary exercise equipment is generally designed for a broad range of exercises, targeting most or all of the bodies major muscle groups. By definition, however, stationary exercise equipment is not portable, requiring a dedicated location for its placement. Typically, multi-purpose stationary exercise equipment is designed with floor mounted frames, cables and pulleys, and incorporate heavy weights, bows, band, springs or other mechanical means as the resistance force for the exercises. The more complex and comprehensive the exercise equipment becomes in terms of the type and number of exercises that can be performed with the equipment, the exercise equipment also becomes more complex, more bulky, more expensive, and less mobile. Because this type of exercise equipment is meant to be stationary, it's most often found in gyms, athletic facilities, training and rehabilitation centers, and to a lesser degree in homes.

In light of the above, it is the object of the present invention to provide a portable exercise device that does not require weights, bows, bands, springs or other mechanical means for creating the resistance force for the exercises. Another object of the present invention is to provide an exercise device that includes a structure that can be easily manipulated by the user to provide the desired level of resistance. Another object of the present invention is to provide an exercise device that is compact, light-weight and portable. Another object of the present invention is to provide an exercise device that can be used to exercise several muscle groups in the body of the user. Another object of the present invention is to provide an exercise device that is easy to use. Yet another object of the invention is to provide an exercise devise that is relatively easy to manufacture and is comparatively cost effective.

Other objects, features and advantages of the invention will become apparent from the following description, taken in conjunction with the accompanying drawings, which illustrate, by way of examples, the principle of the invention.

SUMMARY OF THE INVENTION

An exercise device according to the present invention includes a first lever, a second lever, a connecting rod, a first arm and a second arm. The connecting rod pivotally interconnects one end of the first lever with the second lever. The connections between the first lever and the connecting rod and between the second lever and the connecting rod define axes of rotation that are substantially perpendicular to the first lever, second lever and connecting rod. The end of the first lever that is closest to the interconnection with the connecting rod is pivotally connected to a frame about an axis of rotation that is substantially perpendicular to the frame and the first lever. In one embodiment, the first lever includes a force input structure that is located at the end of the first lever opposite the end pivotally connected to a frame. In a preferred embodiment this structure is a handle. One end of the second lever is pivotally connected to the frame about an axis of rotation that is substantially perpendicular to the frame and the second lever. The first arm is pivotally connected to the frame about an axis of rotation that is substantially perpendicular to the frame. The other end of the first arm is pivotally connected to a second arm about an axis of rotation that is substantially perpendicular to the first arm and the second arm. The other end of the second arm is pivotally attached to the end of the second lever that is not pivotally attached to a frame, about an axis of rotation that is substantially perpendicular to the second arm and the second lever. In a preferred embodiment, a seat for the user is attached to the second arm.

In the operation of the exercise device, the first lever is rotated about its pivotal connection to the frame, which causes the connecting rod to apply a force against the second lever. In response to this force, the second lever rotates about its pivotal connection to the frame. As the second lever rotates, it causes the end of the second arm that is pivotally attached to the second lever to follow the rotational motion of the second lever at their pivotal interconnection. The consequences of the second arm's movement is that the pivotal interconnection of the second arm with the first arm effects a rotation of the first arm about its pivotal connection to the frame.

As the first lever is rotated about its pivotal connection to the frame it encounters resistance that is proportional to the body weight of a user seated on the seat, the geometric relationships between the axes of rotation described above, and the lengths of the first lever, second lever, first arm and second arm.

In one embodiment of the exercise device, control over the amount of resistance there is to the rotation of the first lever is accomplished at the interconnection of the connecting rod and the second lever. For this embodiment the connecting rod is not attached directly to the second lever. Instead it is pivotally attached to a slide assembly about an axis of rotation that is substantially perpendicular to the connecting rod and slide assembly. The slide assembly is positioned on the second lever in a manner that it can be slid along the second lever, positioned at various points along the second lever and be intermittently fixed at said various points by the insertion of a lock pin that interlocks the slide assembly and the second lever. This allows the distance between the axis of rotation about which the second lever rotates with respect to a frame and the axis of rotation between the connecting rod and the slide assembly to be adjusted. The closer that the slide assembly is positioned to the end of the second lever that is pivotally attached to the frame, and thus the shorter the distance between the second levers axis of rotation with the frame and the pivotal interconnection between the connecting rod and the slide assembly, the higher the force required to rotate the first lever, and therefore, the higher the exercise resistance. Conversely, the further that the slide assembly is positioned from the end of the second lever that is pivotally attached to the frame, and thus the greater the distance between the second levers axis of rotation with the frame and the pivotal interconnection between the connecting rod and the slide assembly, the lower the force required to rotate the first lever about its pivotal attachment to the frame, and therefore the lower the exercise resistance. Accordingly, depending on the position of the slide assembly on the second lever, the resistance to rotation of the first lever can be increased or decreased.

In one embodiment of the exercise device, the end of the first lever with the force input structure is pivotally connected to the end of the first lever that is pivotally connected to a frame. Specifically, for this purpose the end of the first lever with the input structure is inserted into an adopter, which is pivotally attached to the end of the first lever that is pivotally attached to the frame. With this cooperation of structure the user is able to rotate the end of the first lever with the input structure relative to the end of the first lever that is pivotally attached to the frame.

The exercise device of the present invention can be used by an individual to exercise, for example, gluteus maximus muscles. To do so, the individual sets the exercise resistance according to their strength and exercise goals. After setting the resistance, the individual places their feet on the input structure that is attached to the first lever. The individual can then exert force against the input structure causing the first lever to rotate about its pivotal connection to the frame. The user then reduces the amount of force they are exerting against the input structure, allowing the first lever to return to its original position.

BRIEF DESCRIPTION OF THE DRAWINGS

The novel features of the present invention, as well as the invention itself, both as to its structure and its operation, will be best understood from the accompanying drawings which are meant to illustrate and not limit the invention, taken in conjunction with the accompanying description, in which similar reference characters refer to similar parts, and in which.

DETAILED DESCRIPTION OF THE PREFERRED EMBODIMENT

Figure 1A:
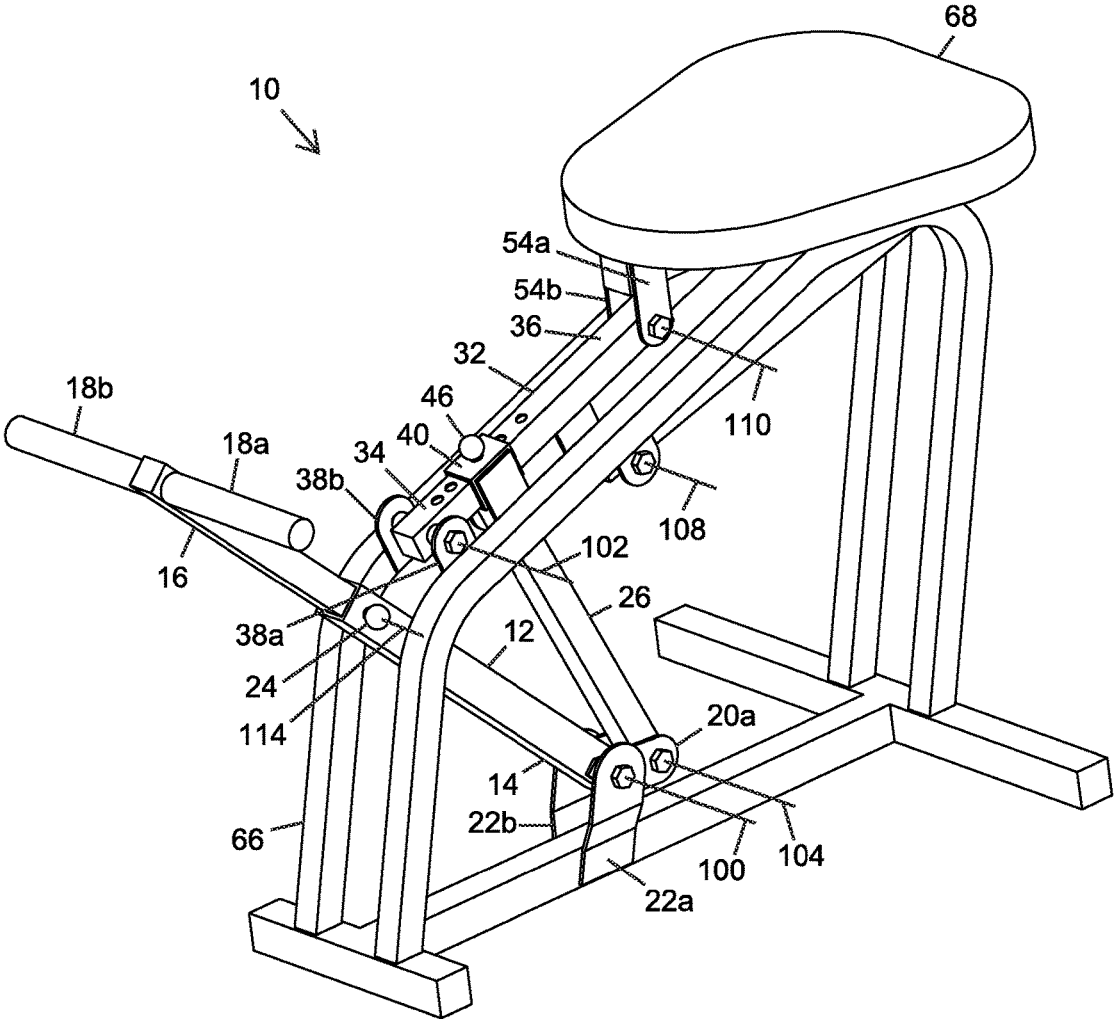
FIGS. 1A and 1B are perspective views of an exercise device of the present invention.
Figure 1B:
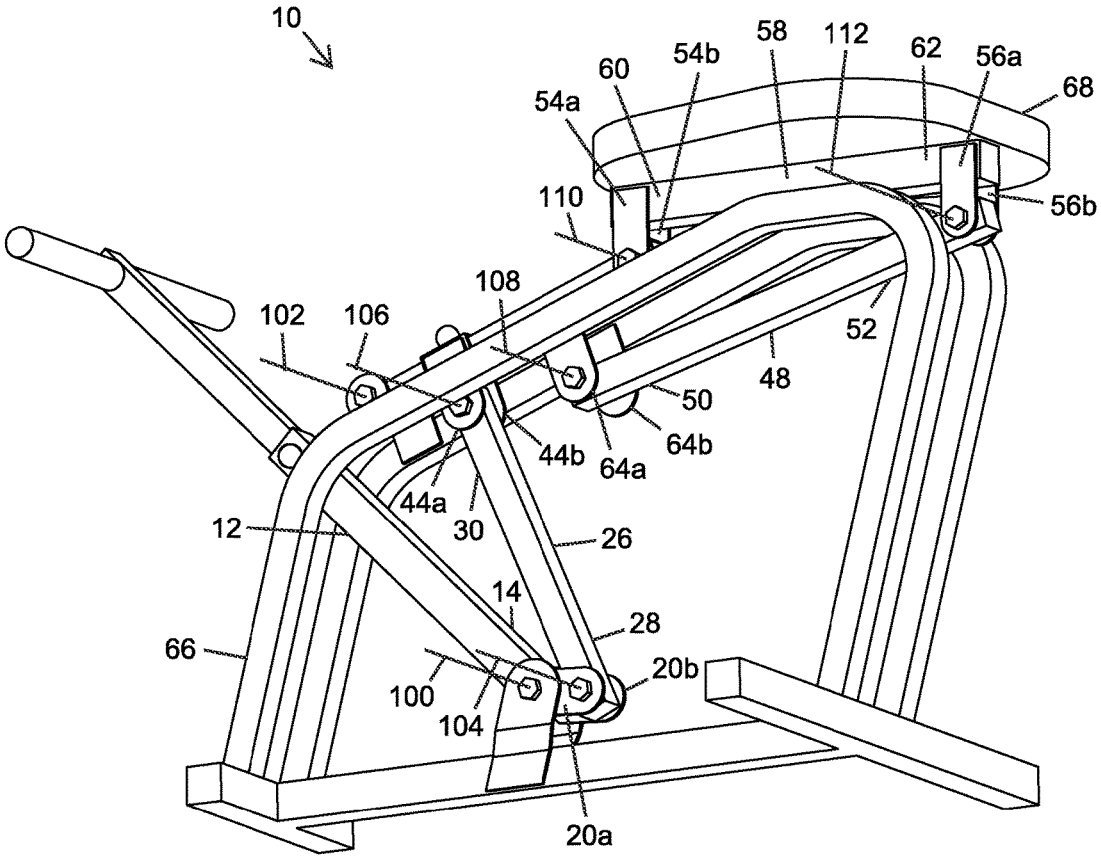

A first embodiment of an exercise device is shown in FIGS. 1A and 1B and is generally designated 10. As shown in FIG. 1A the device 10 includes a first lever 12, which has a first end 14 and a second end 16. Additionally, first lever 12 has pin 24 that can be manipulated in a manner well known in the art to adjust the length of first lever 12.

Referring again to FIG. 1A, the first lever 12 has handles 18*a* and 18*b* that are attached at second end 16 by means such as welding, or the like, and plates 20*a* and 20*b* (FIG. 1B) that are attached to first end 14 by means such as welding, or the like. The exercise device also has brackets 22*a* and 22*b* that are attached to frame 66 by means such as welding, or the like. First end 14 is pivotally attached to brackets 22*a* and 22*b* at first axes 100, which is substantially perpendicular to frame 66, such that first lever 12 can rotate about first axis 100.

FIG. 1A also shows that the device 10 includes second lever 32, which has first end 34 and second end 36. The exercise device also includes brackets 38*a* and 38*b* that are attached to frame 66 by means such as welding, or the like. First end 34 is pivotally attached to brackets 38*a* and 38*b* at second axes 102, which is substantially perpendicular to frame 66, such that second lever 32 can rotate about second axis 102. Slide assembly 40 is positioned on second lever 32.

Figure 2A:
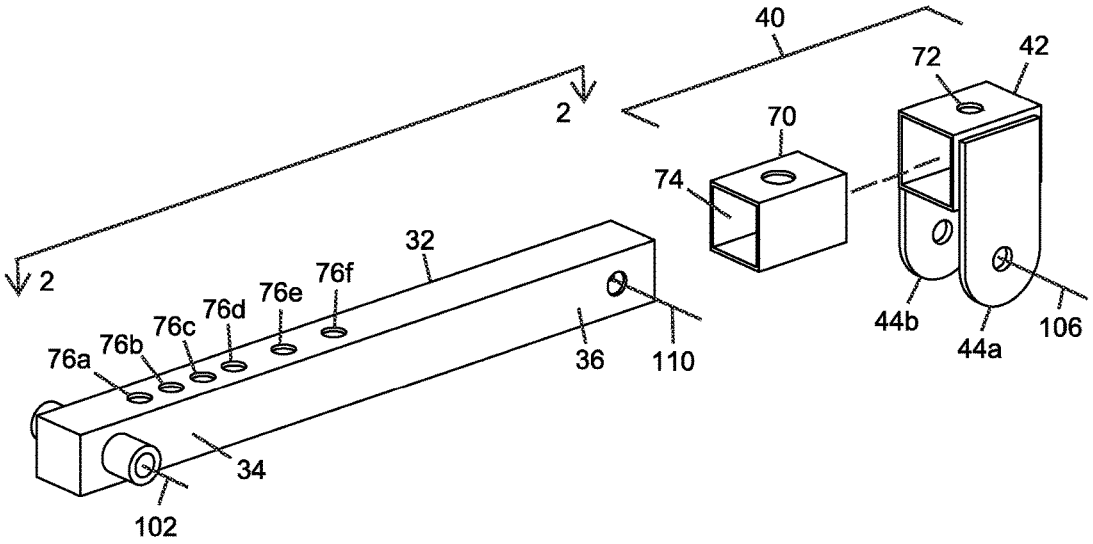
FIG. 2A is a partially exploded perspective view of a slide assembly and a second lever of an exercise device of the present invention.
Figure 3:
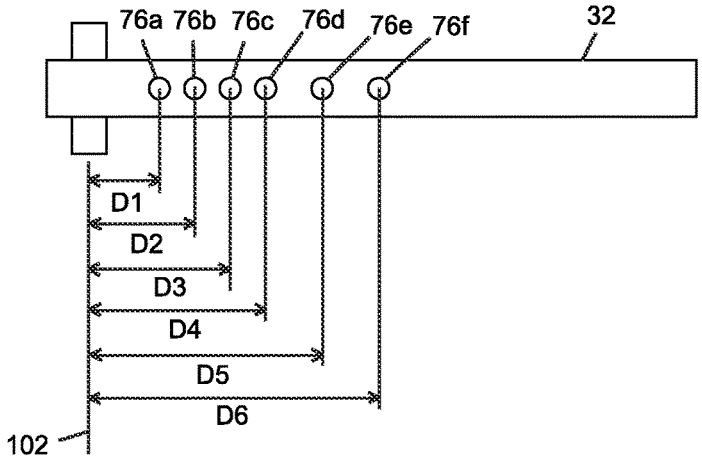
FIG. 3 is a view of a second lever of an exercise device of the present invention as would be seen along the line 2-2 in FIG. 2A.

Turning now to FIG. 2A, slide assembly 40 and second lever 32 are shown in detail. As shown in FIG. 2A, the slide assembly 40 preferably includes bushing 70, slider 42 and plates 44*a* and 44*b*. Slider 42 has hole 72. Plates 44*a* and 44*b* are attached to slider 42 by means such as welding, or the like, and bushing 70 is installed internally to slider 42 by means such as a press fit, snap fit, adhesive, or the like. Bushing 70 has an internal surface 74 of a size and configuration to receive second lever 32 such that slide assembly 40 can slide on second lever 32. Preferably, second lever 32 has holes, 76*a*, 76*b*, 76*c*, 76*d*, 76*e* and 76*f*. Referring to FIG. 3, holes 76*a*, 76*b*, 76*c*, 76*d*, 76*e* and 76*f* are spaced linearly along second lever 32 at distances from second axis 102 referenced as D1, D2, D3, D4, D5 and D6 respectively. However, those of ordinary skill in the art will understand that more or less holes are suitable.

Figure 2B:
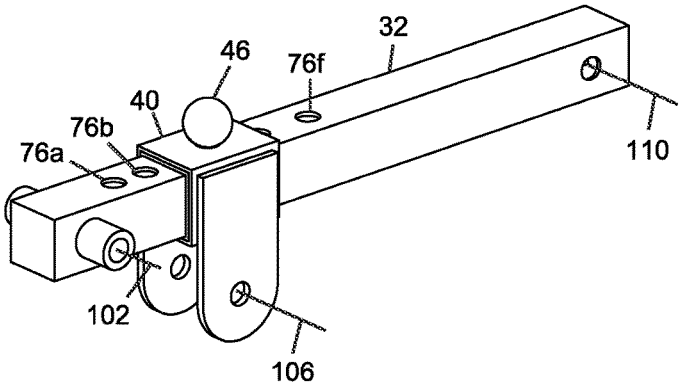
FIG. 2B is a perspective view of a slide assembly installed on a second lever of an exercise device of the present invention.

FIG. 2B shows slide assembly 40 installed on second lever 32. To position and affix slide assembly 40 along second lever 32, hole 72 is aligned with one of the holes 76*a*, 76*b*, 76*c*, 76*d*, 76*e* or 76*f*, whereupon lock pin 46 is inserted through hole 72 and through the corresponding hole 76*a*, 76*b*, 76*c*, 76*d*, 76*e* or 76*f* that it is aligned with.

FIG. 1B shows that the device 10 includes connecting rod 26, which has a first end 28 and a second end 30. First end 28 is pivotally attached to plates 20*a* and 20*b* at third axis 104, which is substantially perpendicular to frame 66, such that connecting rod 26 can rotate about third axis 104. Second end 30 is pivotally attached to plates 44*a* and 44*b* at fourth axis 106, which is substantially perpendicular to frame 66, such that connecting rod 26 can rotate about fourth axis 106.

Still referring to FIG. 1B, the device 10 includes first arm 48, which has first end 50 and second end 52. The exercise device also has plates 64*a* and 64*b* that are attached to frame 66 by means such as welding, or the like. First end 50 is pivotally attached to plates 64*a* and 64*b* at fifth axis 108, which is substantially perpendicular to frame 66, such that first arm 48 can rotate about fifth axis 108. The device 10 includes second arm 58, which has first end 60 and second end 62. Plates 54*a* and 54*b* (FIG. 1A) are attached to first end 60 by means such as welding, or the like, and plates 56*a* and 56*b* are attached to second end 62 by means such as welding, or the like. Plates 54*a* and 54*b* are pivotally attached to second end 36 (FIG. 1A) at sixth axes 110, which is substantially perpendicular to frame 66, such that second arm 58 can rotate about sixth axis 110. Plates 56*a* and 56*b* are pivotally attached to second end 52 at seventh axes 112, which is substantially perpendicular to frame 66, such that second arm 58 can rotate about seventh axis 112. Seat 68 is attached to second arm 58 by means such as screws (not shown). In an embodiment of the invention, second lever 32, first arm 48, second arm 58 or seat 68 is supported in the resting position shown in FIGS. 1A and 1B by means such as a rubber stop (not shown) affixed to frame 66.

Figure 4:
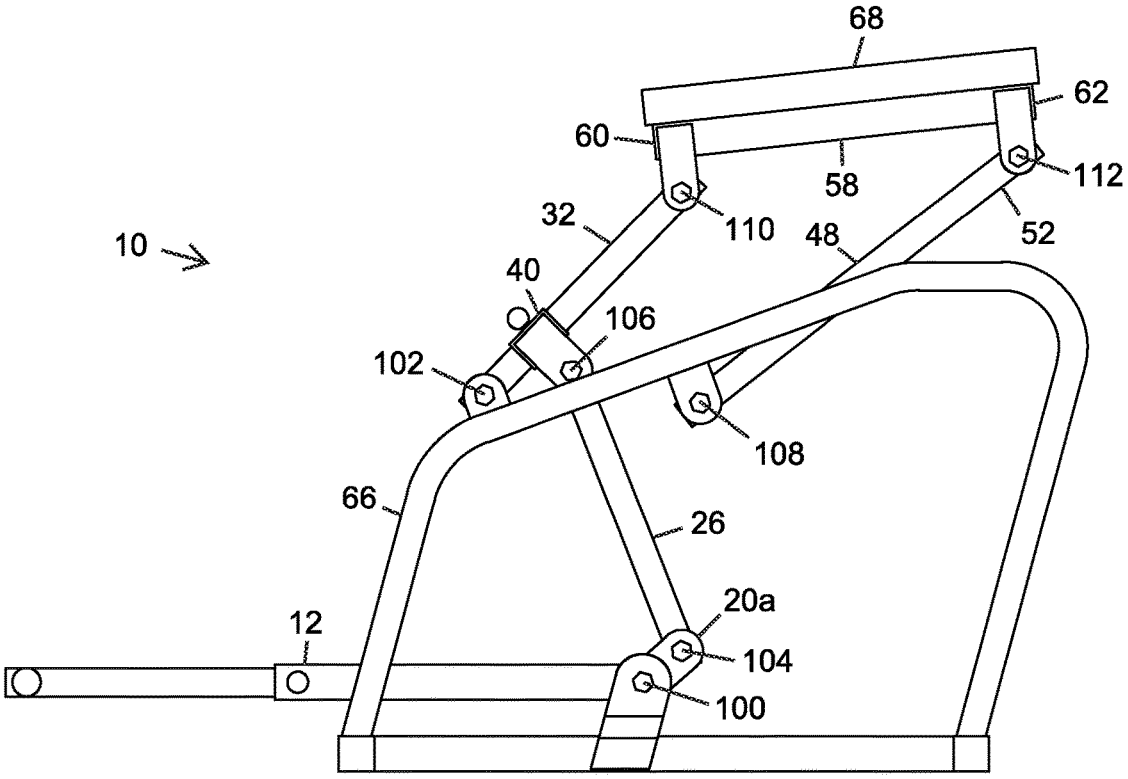
FIG. 4 is a side elevation view of an exercise device of the present invention.

FIG. 4 illustrated the device 10 wherein the first lever 12 has been rotated counterclockwise about first axis 100 (perpendicular to the plane of FIG. 4). As can be seen, this rotation of first lever 12 results in plates 20*a* and 20*b* (not shown) also rotating counterclockwise about first axis 100. It will be appreciated by a skilled artisan that due to the pivotal interconnection of first lever 12 and connecting rod 26 at third axis 104 (perpendicular to the plane of FIG. 4), a rotation of first lever 12 will cause connecting rod 26 to interact at fourth axis 106 with slide assembly 40, affixed on second lever 32, in a manner that will effect a rotation of second lever 32 about second axis 102 (perpendicular to the plane of FIG. 4). The first end 60 of second arm 58 follows the rotation of second lever 32 at their pivotal interconnection at sixth axis 110 (perpendicular to the plane of FIG. 4). The consequences of this is that it effects a rotation of first arm 48 about fifth axis 108 (perpendicular to the plane of FIG. 4), caused by the pivotal interaction of second end 62 with second end 52 at seventh axis 112 (perpendicular to the plane of FIG. 4).

Still referring to FIG. 4, a skilled artesian will recognize from the disclosure herein that first lever 12 can extended to the right from first axis 100, versus to the left as shown in FIG. 4, in which case first lever 12 will have rotated clockwise about first axis 100.

Figure 5A:
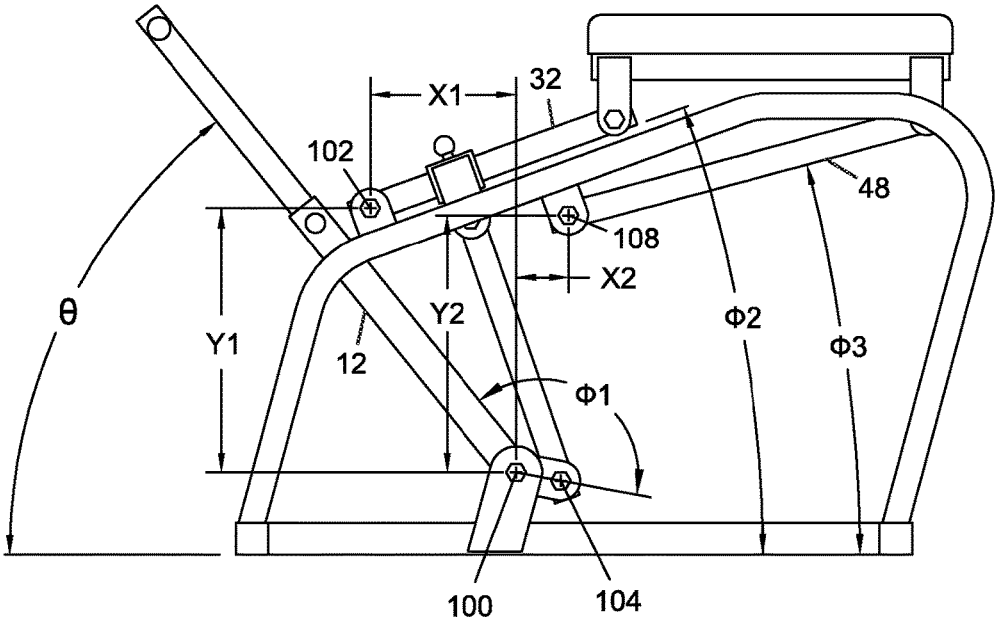
FIG. 5A is a side elevation view of an exercise device of the present invention.
Figure 5B:
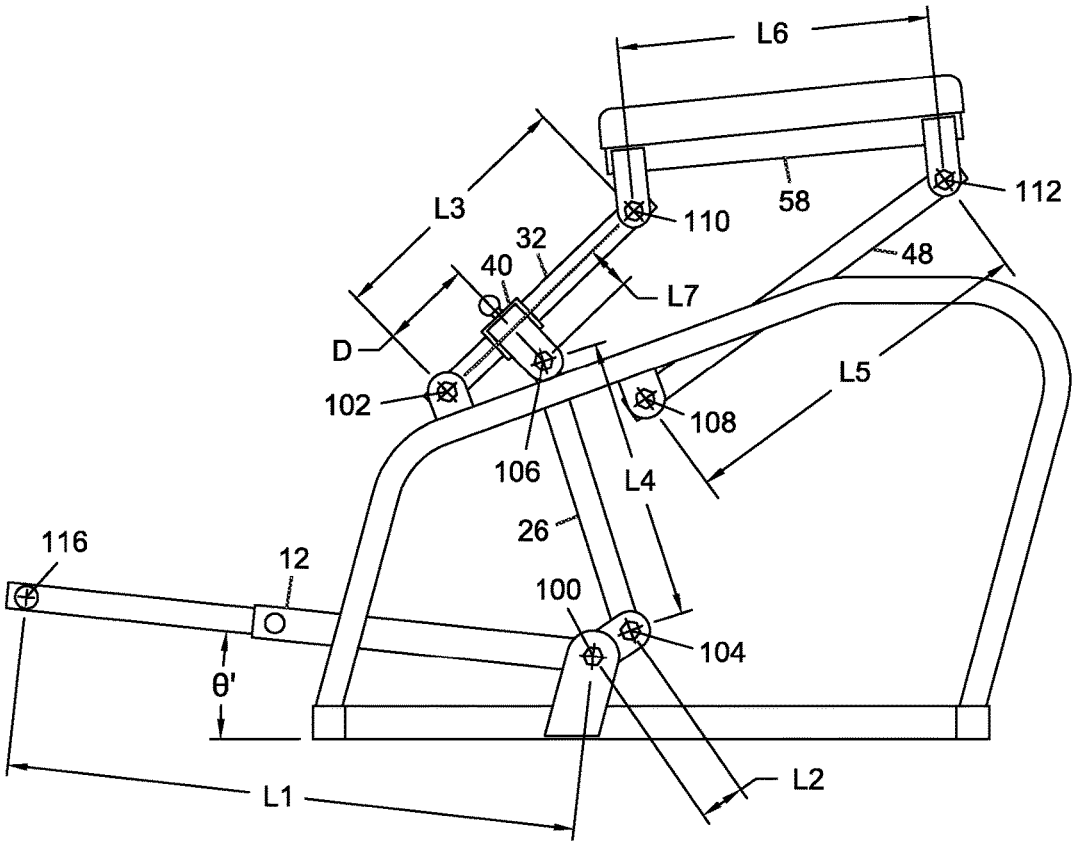
FIG. 5B is a side elevation view of an exercise device of the present invention.

FIGS. 5A and 5B illustrates the device 10 having dimensions and angles according to an embodiment of the invention. Referring to FIG. 5A, the position of second axis 102 (perpendicular to the plane of FIG. 5A) relative to first axis 100 (perpendicular to the plane of FIG. 5A) is referenced as X1 in the horizontal direction and as Y1 in the vertical direction. The position of the fifth axis 108 (perpendicular to the plane of FIG. 5A) relative to the first axis 100 is referenced as X2 in the horizontal direction and as Y2 in the vertical direction. The angle of a line drawn between first axis 100 and third axis 104 (perpendicular to the plane of FIG. 5A) relative to first lever 12 is referenced as angle ϕ1, the angle of second lever 32 relative to the horizontal is referenced as angle ϕ2, and the angle of first arm 48 relative to the horizontal is referenced as angle ϕ3.

Referring to FIG. 5B, lever 12 has been rotated from angle 0 shown in FIG. 5A to angle θ' shown in FIG. 5B. The length of first lever 12 between first axis 100 (perpendicular to the plane of FIG. 5B) and ninth axis 116 (perpendicular to the plane of FIG. 5B) is referenced as "L1", the distance between first axis 100 and third axis 104 (perpendicular to the plane of FIG. 5B) is referenced as "L2", the length of second lever 32 between second axis 102 (perpendicular to the plane of FIG. 5B) and sixth axis 110 (perpendicular to the plane of FIG. 5B) is referenced as "L3", the length of connecting rod 26 between third axis 104 and fourth axis 106 (perpendicular to the plane of FIG. 5B) is referenced as "L4", the length of first arm 48 between fifth axis 108 (perpendicular to the plane of FIG. 5B) and seventh axis 112 (perpendicular to the plane of FIG. 5B) is referenced as "L5", and the length of second arm 58 between sixth axis 110 and seventh axis 112 is referenced as "L6". The distance between fourth axis 106 and a line drawn between second axis 102 and sixth axis 110 is referenced as "L7". The position of slide assembly 40 along second lever 32 relative to second axis 102 is referenced as "D".

In an embodiment of the invention, the dimensions and angles referenced in FIGS. 3, 5A and 5B have the following respective values; however, those of ordinary skill in the art will understand from the disclosure herein that there are many values for the referenced dimensions and angles that are suitable for the device 10:

Referring to FIG. 3:

D1=1 ⅝ inches
D2=⅝ inch
D3=⅝ inch
D4=⅝ inch
D5=1 inch
D6=1 inch Referring to FIG. 5A:

X1=5 ⅝ inches
X2=2 inches
Y1=10 3/16 inches
Y2=9 ⅞ inches
ϕ1=140 degrees
ϕ2=20 degrees
ϕ3=15 degrees Referring to FIG. 5B:

L1=22 inches

L2=1 ¼ inches

L3=10 inches

L4=10 11/16 inches

L5=14 ¼ inches

L6=12 inches

L7=1 ¾ inches

In the operation of the device 10, a user 98 (FIG. 8A) will first set the exercise resistance that is to be provided by device 10 by positioning slide assembly 40 along second lever 32. Referring to FIGS. 2A and 2B, this is accomplished by moving slide assembly 40 along second lever 32 such that hole 72 is aligned with hole 76*a*, 76*b*, 76*c*, 76*d*, 76*e* or 76*f*, and then inserting lock pin 46 to affix slide assembly 40 to second lever 32. The shorter the distance D (FIG. 5B), the greater the resistance provided by device 10. The greater the distance D (FIG. 5B), the lower the resistance provided by device 10. Accordingly, if hole 72 is aligned with hole 76*a* and lock pin 46 is inserted in said holes, the exercise device will provide its maximum resistance. If hole 72 is aligned with hole 76*f* and lock pin 46 is inserted in said holes, the exercise device will provide its minimum resistance. The amount of resistance provided by the device 10 is also dependent upon the bodyweight of user 98 positioned on seat 68.

Figure 6:
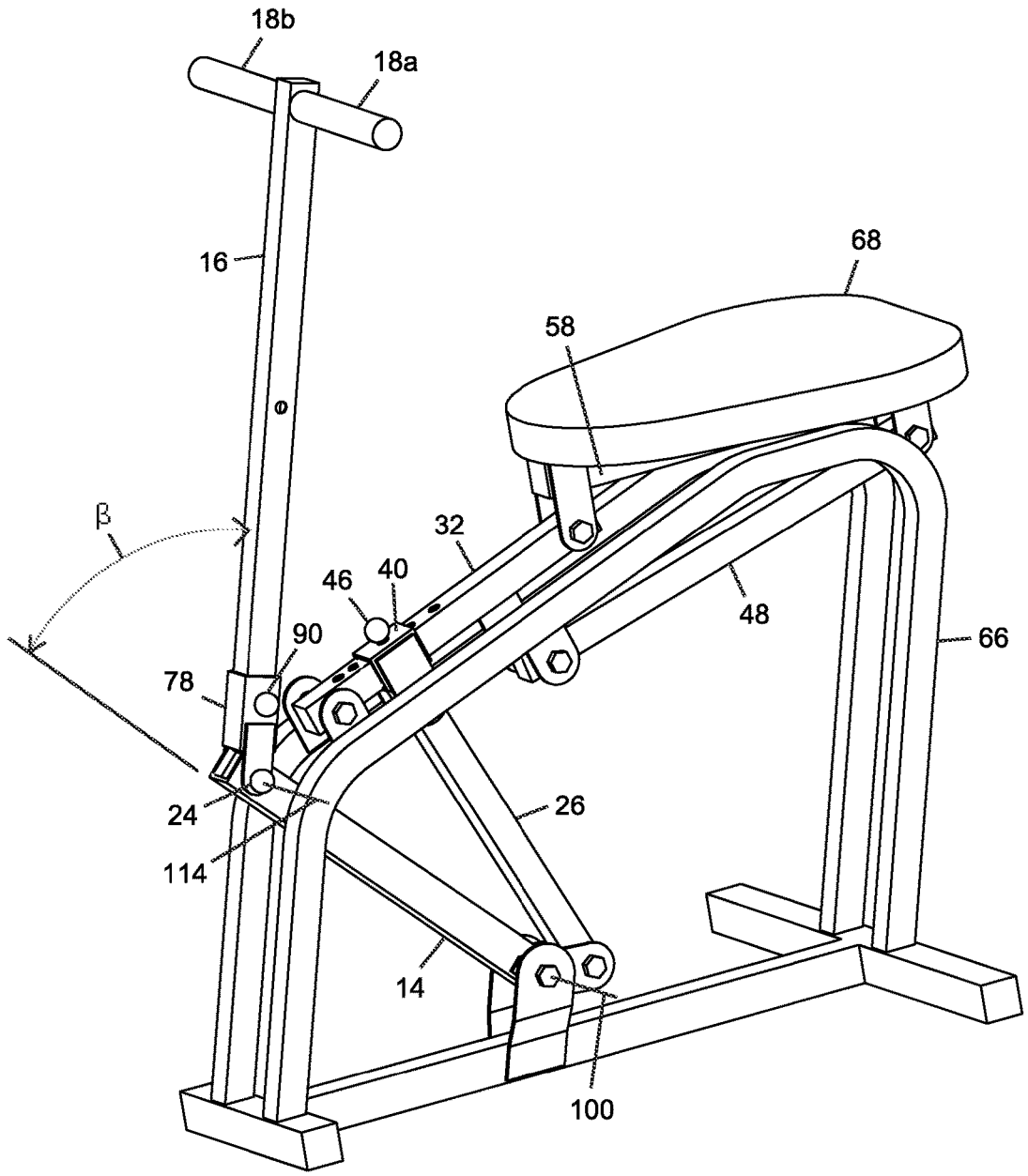
FIG. 6 is a perspective view of an embodiment of an exercise device of the present invention.
Figure 7:
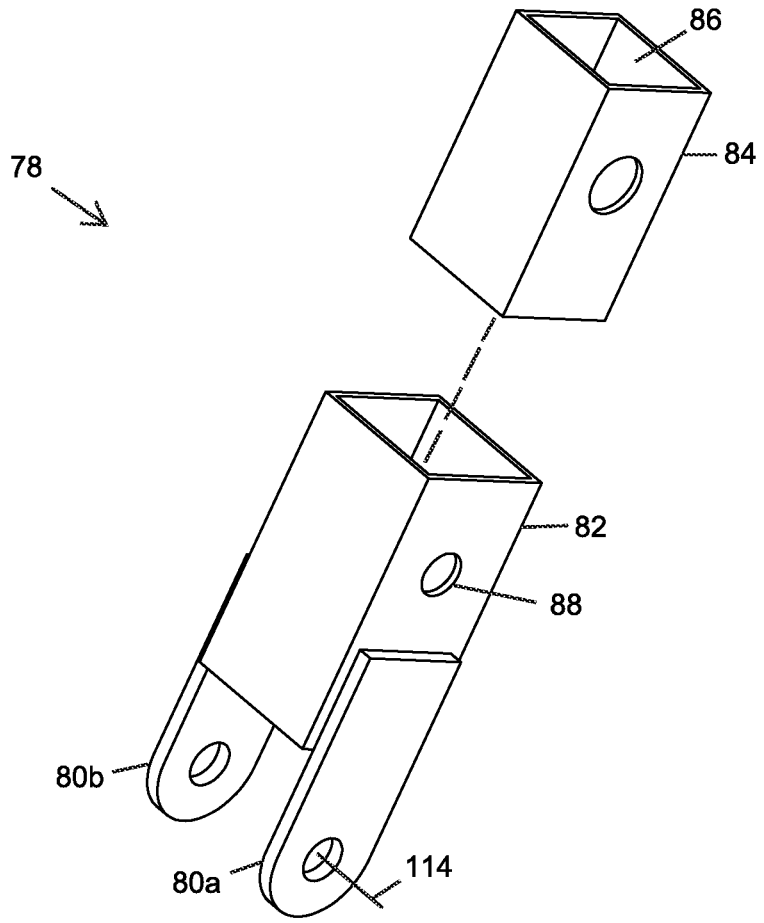
FIG. 7 is a partially exploded perspective view of an adapter.

FIG. 6 illustrates an embodiment of the invention wherein second end 16 is pivotally attached to first end 14 at variable angle β utilizing adapter 78, which is pivotally attached to first end 14 utilizing pin 24 at eighth axis 114, which is substantially perpendicular to frame 66, by means well known to a skilled artisan. Turning to FIG. 7, the adopter 78 is shown in detail. There it can be seen that plates 80*a* and 80*b* are attached to tube 82 by means such as welding, or the like. Bushing 84 is installed internally to tube 82 by means such as a press fit, snap fit, adhesive, or the like. Bushing 84 has an internal surface 86 of a size and configuration to receive second end 16. Adopter 78 has hole 88. Referring again to FIG. 6, second end 16 is inserted into bushing 84, and in the preferred embodiment, pin 90 is inserted through hole 88 and a corresponding hole (not shown) in second end 16 to retain second end 16 in adopter 78. However, a skilled artisan would recognize a wide number of ways, from the disclosure herein, to pivotally interconnect second end 16 with first end 14.

Figure 8A:
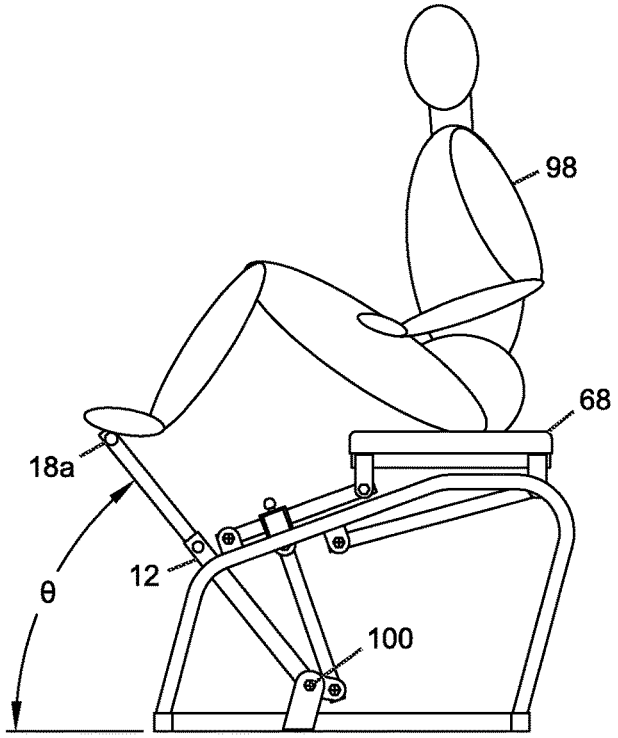
FIGS. 8A and 8B are side elevation views of a user with the exercise device shown in FIGS. 1A and 1B, with the user's feet on the handle.
Figure 8B:
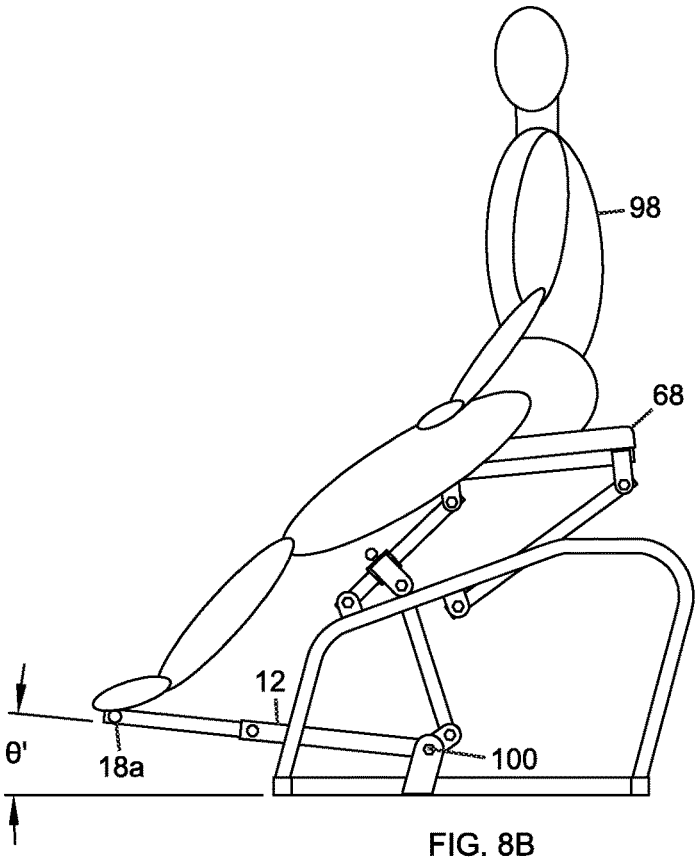

FIGS. 8A and 8B show an exemplary use of the device 10 for exercising the gluteus maximus muscles of user 98 seated on device 10. Referring to FIG. 8A, after first setting the exercise resistance as described above, user 98 places their feet on handles 18A and 18B (not shown), then as user 98 extends their legs, causing first lever 12 to rotate about first axis 100 (perpendicular to the plane of FIG. 8A) from angle θ to angle θ' (FIG. 8B), resistance force is generated by the body weight of user 98 as seat 68 raises to the position shown in FIG. 8B. The resistance force continues to be generated as user 98 reduces the force they are exerting on handles 18*a* and 18*b*, thereby returning to the starting position shown in FIG. 8A.

Figure 9A:
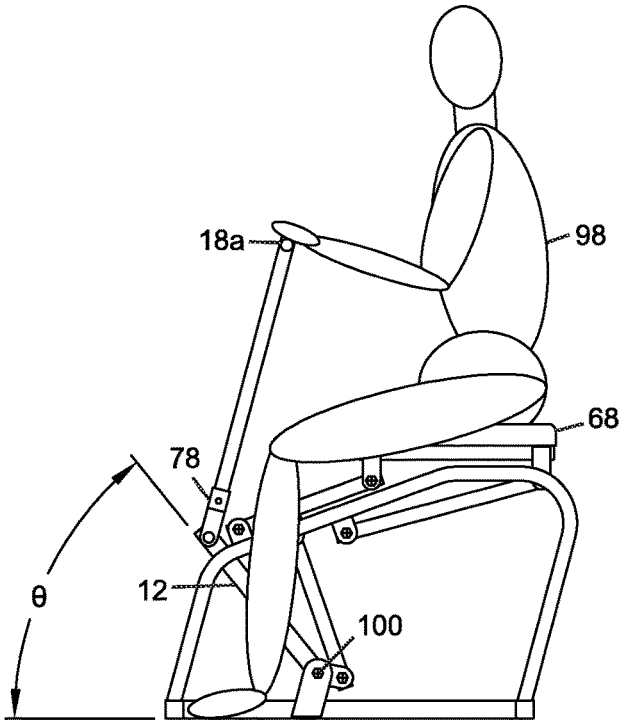
FIGS. 9A and 9B are side elevation views of a user with the exercise device shown in FIG. 6, with the user's hands on the handle.
Figure 9B:
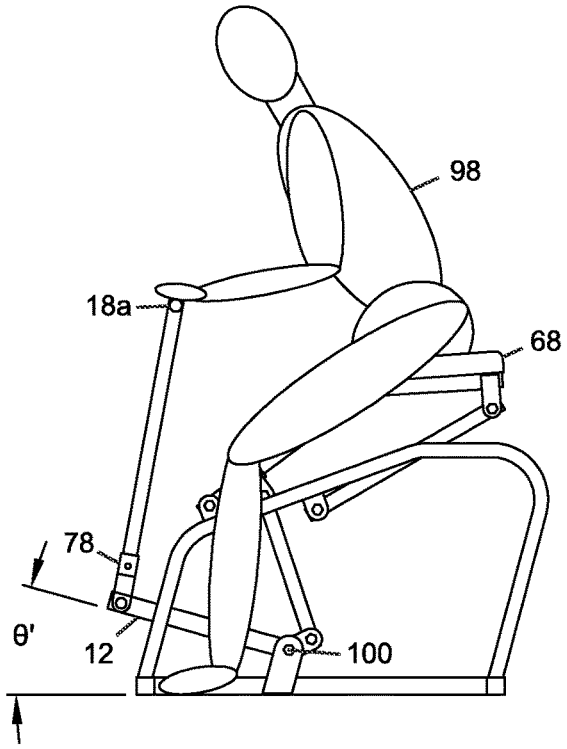

FIGS. 9A and 9B show a use of the device 10 for exercising the abdominal muscles of user 98 seated on device 10. Referring to FIG. 9A, after first setting the exercise resistance as described above, user 98 places their hands on handles 18A and 18B (not shown), then as user 98 rotates their upper body in a downward direction, forcing handles 18A and 18B towards the floor, which causes first lever 12 to rotate about first axis 100 (perpendicular to the plane of FIG. 9A) from angle θ to angle θ' (FIG. 9B), resistance force is generated by the body weight of user 98 as seat 68 raises to the position shown in FIG. 9B. The resistance force continues to be generated as user 98 reduces the force they are exerting on handles 18*a* and 18*b*, thereby returning to the starting position shown in FIG. 9A.

Figure 10A:
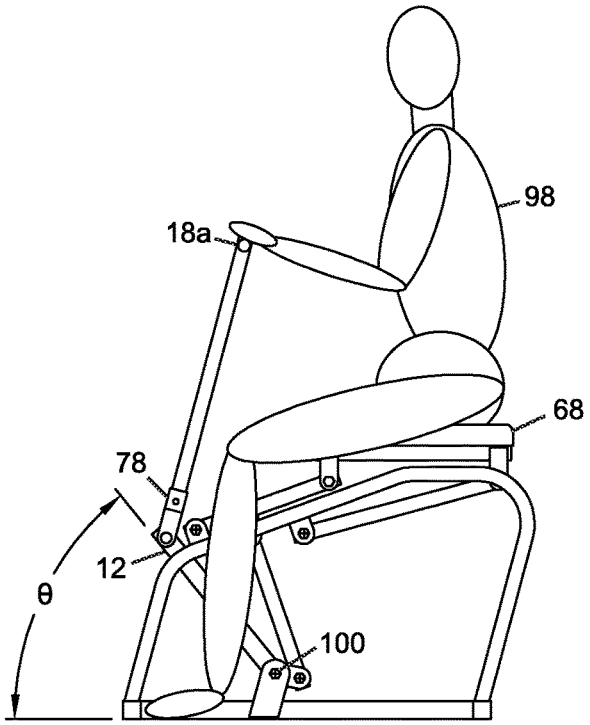
FIGS. 10A and 10B are side elevation views of a user with an exercise device shown in FIG. 6, with the user's hands on the handle.
Figure 10B:
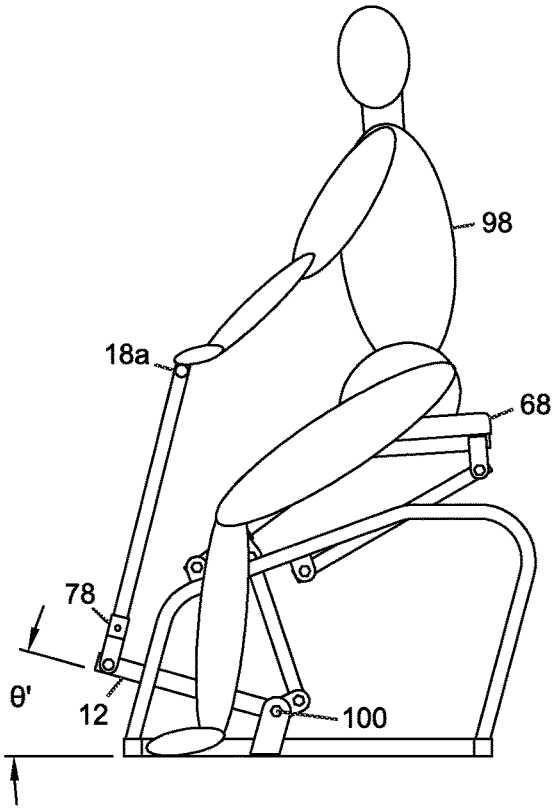

FIGS. 10A and 10B show a use of the device 10 for exercising the upper body and arm muscles of user 98 seated on device 10. After first setting the exercise resistance as described above, user 98 places their hands on handles 18A and 18B (not shown), then as user 98 pushes their hands down, causing first lever 12 to rotate about first axis 100 (perpendicular to the plane of FIG. 10A) from angle θ to angle θ' (FIG. 10B), resistance force is generated by the body weight of user 98 as seat 68 raises to the position shown in FIG. 10B. The resistance force continues to be generated as user 98 reduces the force they are exerting on handles 18*a* and 18*b*, thereby returning to the starting position shown in FIG. 10A.

Figure 11A:
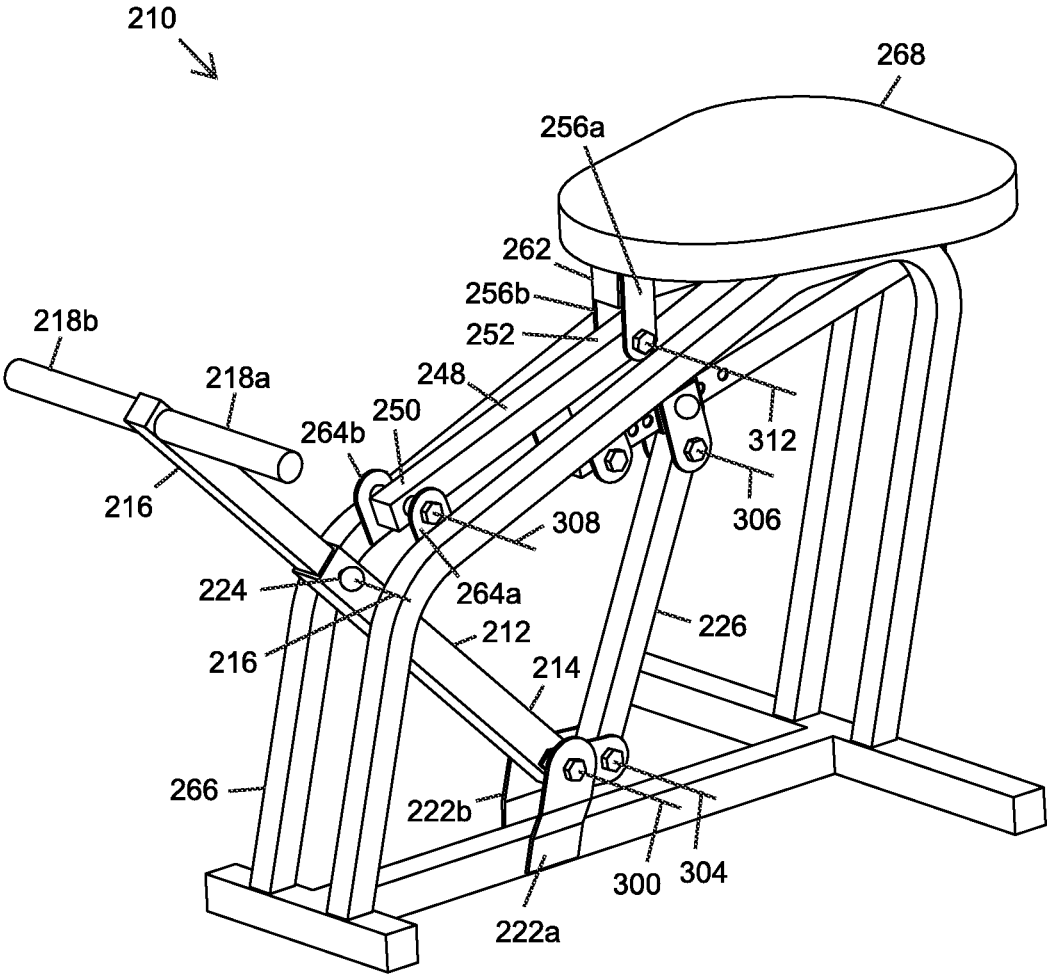
FIGS. 11A and 11B are perspective views of an alternate embodiment of an exercise device.
Figure 11B:
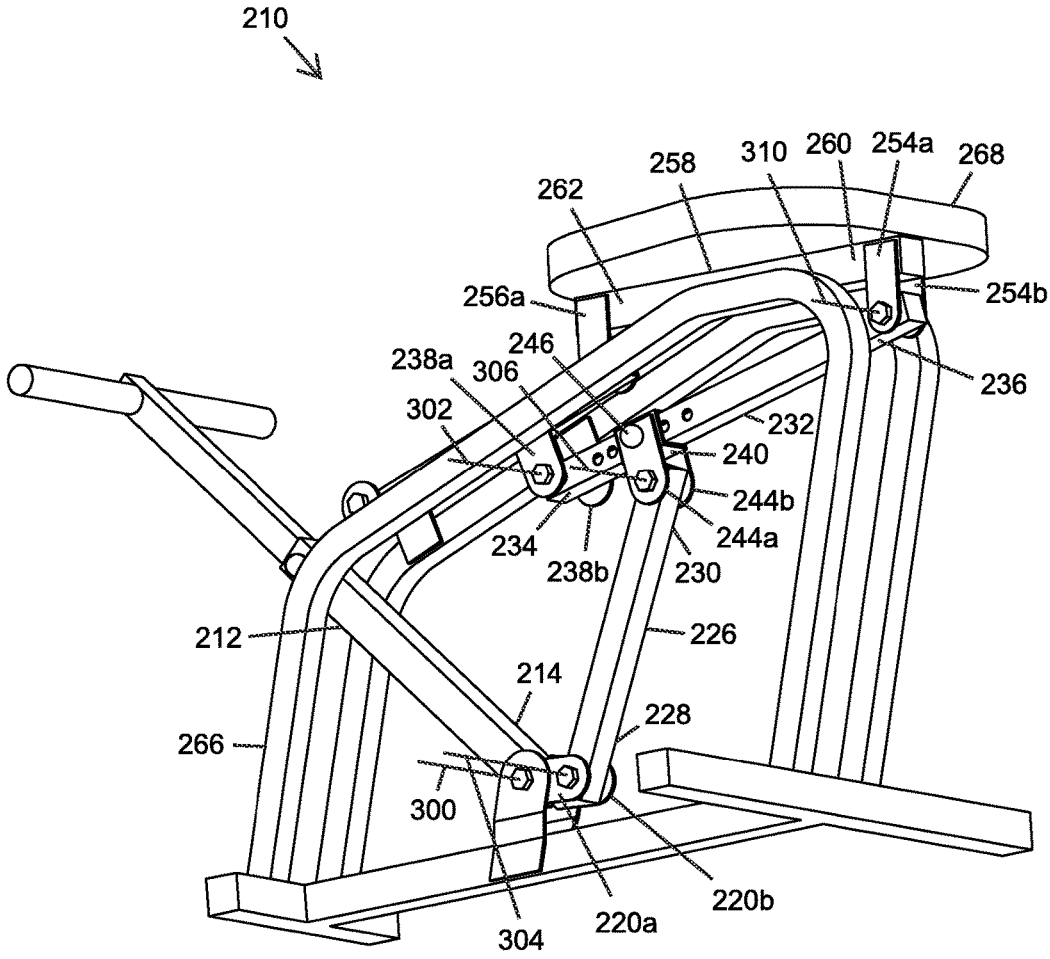

Another embodiment of an exercise device is shown in FIGS. 11A and 11B and is generally designated 210. As shown in FIG. 11A, the device 210 includes a first lever 212, which has a first end 214 and a second end 216. Additionally, first lever 212 has pin 224 that can be manipulated in a manner well known in the art to adjust the length of first lever 212.

Referring again to FIG. 11A, first lever 212 has handles 218*a* and 218*b* that are attached at second end 216 by means such as welding, or the like, and plates 220*a* (FIG. 11B) and 220*b* (FIG. 11B) that are attached to first end 214 by means such as welding, or the like. The device 10 also has brackets 222*a* and 222*b* that are attached to frame 266 by means such as welding, or the like. First end 214 is pivotally attached to brackets 222*a* and 222*b* at first axes 300, which is substantially perpendicular to frame 266, such that first lever 212 can rotate about first axis 300.

Referring to FIG. 11B, the device 210 includes second lever 232, which has first end 234 and second end 236. The exercise device also includes brackets 238*a* and 238*b* that are attached to frame 266 by means such as welding, or the like. First end 234 is pivotally attached to brackets 238*a* and 238*b* at second axes 302, which is substantially perpendicular to frame 266, such that second lever 232 can rotate about second axis 302. Slide assembly 240 is positioned on second lever 232.

Figure 12A:
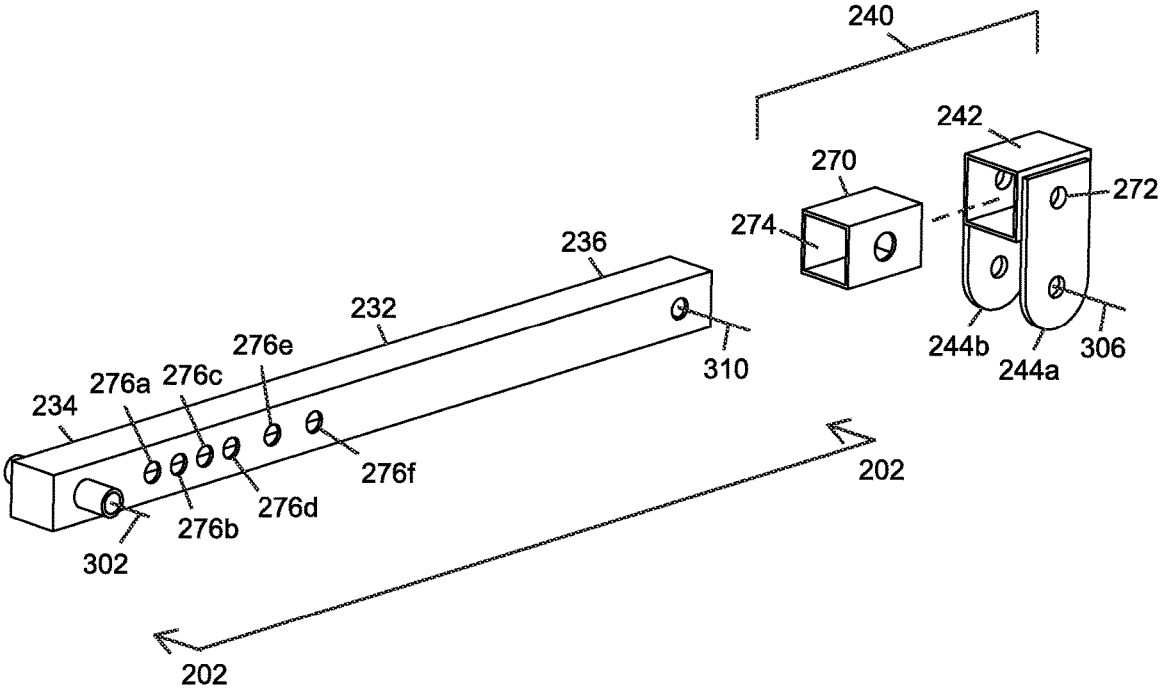
FIG. 12A is a partially exploded perspective view of a slide assembly and a second lever of an exercise device of the present invention.
Figure 13:
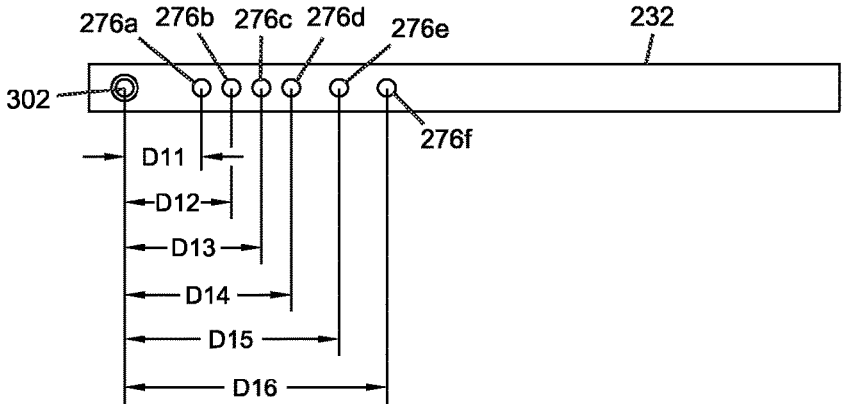
FIG. 13 is a view of a second lever of an exercise device of the present invention as would be seen along the line 202-202 in FIG. 12A.

Turning now to FIG. 12A, slide assembly 240 and second lever 232 are shown in detail. As shown in FIG. 12A, the slide assembly 240 preferably includes bushing 270, slider 242 and plates 244*a* and 244*b*. Plates 244*a* and 244*b* are attached to slider 242 by means such as welding, or the like. Slide assembly 240 has hole 272. Bushing 270 is installed internally to slider 242 by means such as a press fit, snap fit, adhesive, or the like. Bushing 270 has an internal surface 274 of a size and configuration to receive second lever 232 such that slide assembly 240 can slide on second lever 232. Preferably, second lever 232 has holes, 276*a*, 276*b*, 276*c*, 276*d*, 276*e* and 276*f*. Referring to FIG. 13, holes 276*a*, 276*b*, 276*c*, 276*d*, 276*e* and 276*f* are spaced linearly along second lever 232 at distances from second axis 302 (perpendicular to the plane of FIG. 13) referenced as D11, D12, D13, D14, D15 and D16 respectively. However, those of ordinary skill in the art will understand that more or less holes are suitable.

Figure 12B:
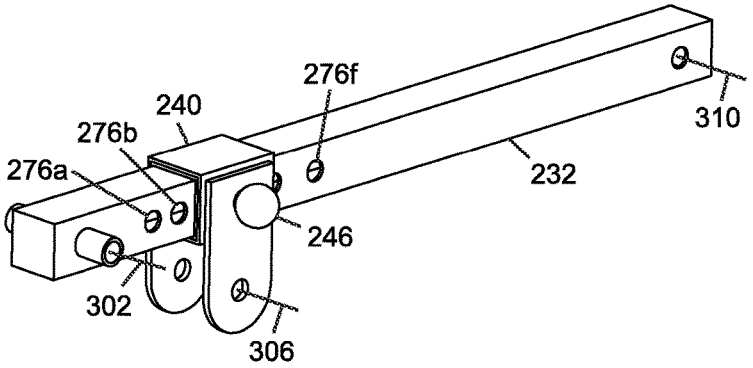
FIG. 12B is a perspective view of a slide assembly installed on a second lever of an exercise device of the present invention.

FIG. 12B shows slide assembly 240 installed on second lever 232. To position and affix slide assembly 240 along second lever 232, hole 272 is aligned with one of the holes 276*a*, 276*b*, 276*c*, 276*d*, 276*e* or 276*f*, whereupon lock pin 246 is inserted through hole 272 and through the corresponding hole 276*a*, 276*b*, 276*c*, 276*d*, 276*e* or 276*f* that it is aligned with.

Referring again to FIG. 11B, device 210 includes connecting rod 226, which has a first end 228 and a second end 230. First end 228 is pivotally attached to plates 220*a* and 220*b* at third axis 304, which is substantially perpendicular to frame 266, such that connecting rod 226 can rotate about third axis 304. Second end 230 is pivotally attached to plates 244*a* and 244*b* at fourth axis 306, which is substantially perpendicular to frame 266, such that connecting rod 226 can rotate about fourth axis 306.

Referring to FIG. 11A, the device 210 includes first arm 248, which has first end 250 and second end 252. The exercise device also has plates 264*a* and 264*b* that are attached to frame 266 by means such as welding, or the like. First end 250 is pivotally attached to plates 264*a* and 264*b* at fifth axis 308, which is substantially perpendicular to frame 266, such that first arm 248 can rotate about fifth axis 308.

Referring again to FIG. 11B, the device 210 includes second arm 258, which has first end 260 and second end 262. Plates 254*a* and 254*b* are attached to first end 260 by means such as welding, or the like, and plates 256*a* and 256*b* (FIG. 11A) are attached to second end 262 by means such as welding, or the like. Plates 254*a* and 254*b* are pivotally attached to second end 236 at sixth axes 310, which is substantially perpendicular to frame 266, such that second arm 258 can rotate about sixth axis 310. Referring to FIG. 11A, plates 256*a* and 256*b* are pivotally attached to second end 252 at seventh axes 312, which is substantially perpendicular to frame 266, such that second arm 258 can rotate about seventh axis 312. Referring to FIG. 11B, seat 268 is attached to second arm 258 by means such as screws (not shown). In an embodiment of the invention, second lever 232, first arm 248, second arm 258 or seat 268 is supported in the resting position shown in FIGS. 11A and 11B by means such as a rubber stop (not shown) affixed to frame 266.

Figure 14:
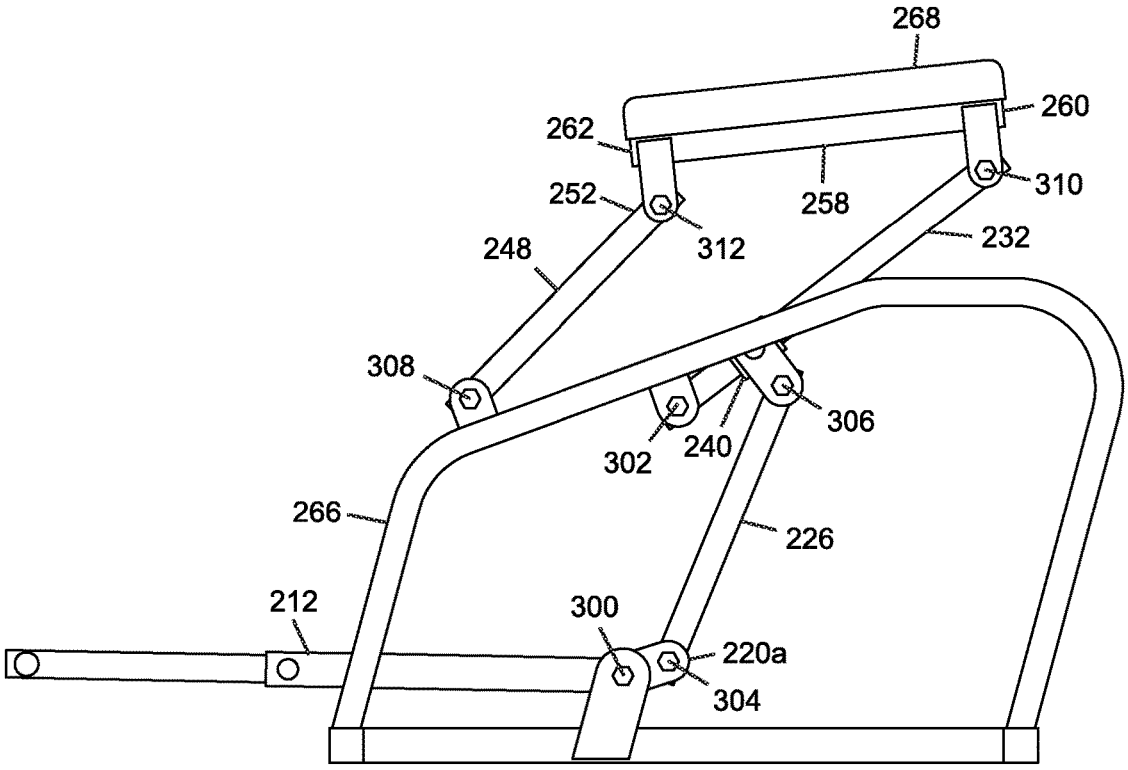
FIG. 14 is a side elevation view of an exercise device of the present invention.

FIG. 14 illustrated the device 210 wherein the first lever 212 has been rotated counterclockwise about first axis 300 (perpendicular to the plane of FIG. 14). As can be seen, this rotation of first lever 212 results in plates 220*a* and 220*b* (not shown) also rotating counterclockwise about first axis 300. It will be appreciated by a skilled artisan that due to the pivotal interconnection of first lever 212 and connecting rod 226 at third axis 304 (perpendicular to the plane of FIG. 14), a rotation of first lever 212 will cause connecting rod 226 to interact at fourth axis 306 with slide assembly 240, affixed on second lever 232, in a manner that will effect a rotation of second lever 232 about second axis 302 (perpendicular to the plane of FIG. 14). The first end 260 of second arm 258 follows the rotation of second lever 232 at their pivotal interconnection at sixth axis 310 (perpendicular to the plane of FIG. 14). The consequences of this is that it effects a rotation of first arm 248 about fifth axis 308 (perpendicular to the plane of FIG. 14), caused by the pivotal interaction of second end 262 with second end 252 at seventh axis 312 (perpendicular to the plane of FIG. 14).

Still referring to FIG. 14, a skilled artesian will recognize from the disclosure herein that first lever 212 can extend to the right from first axis 300, versus to the left as shown in FIG. 14, in which case first lever 212 will have rotated clockwise about first axis 300.

In the operation of the device 210, a user 298 (FIG. 15A) will first set the exercise resistance that is to be provided by device 210 by positioning slide assembly 240 along second lever 232. Referring to FIG. 12A and 12B, this is accomplished by moving slide assembly 240 along second lever 232 such that hole 272 is aligned with hole 276*a*, 276*b*, 276*c*, 276*d*, 276*e* or 276*f*, and then inserting lock pin 246 to affix slide assembly 240 to second lever 232. The closer slide assembly 240 is positioned to second axis 302, the greater the resistance provided by device 210. The further that slide assembly 240 is positioned from second axis 302, the lower the resistance provided by the device 210. Accordingly, if hole 272 is aligned with hole 276*a* and lock pin 246 is inserted in said holes, the exercise device will provide its maximum resistance. If hole 272 is aligned with hole 276*f* and lock pin 246 is inserted in said holes, the exercise device will provide its minimum resistance. The amount of resistance provided by the device 210 is also dependent upon the bodyweight of user 298 positioned on seat 268.

Figure 15:
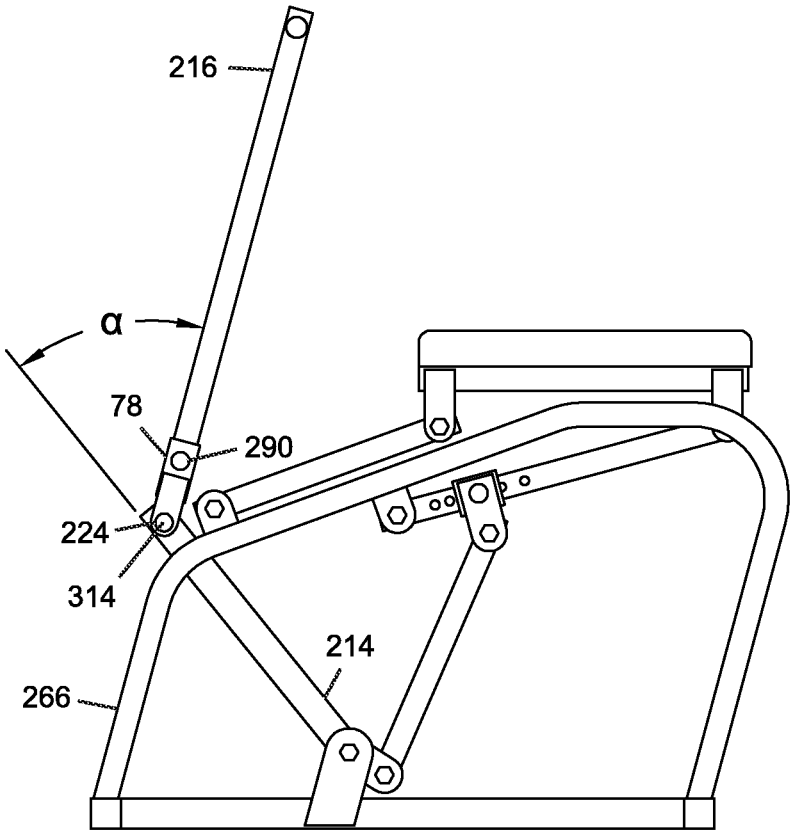
FIG. 15 is a side elevation view of an embodiment of an exercise device of the present invention.

FIG. 15 illustrates an embodiment of the invention wherein second end 216 is pivotally attached to first end 214 at variable angle a utilizing adapter 78, which is pivotally attached to first end 214 utilizing pin 224 at eighth axis 314, which is substantially perpendicular to frame 266 (and the plane of FIG. 15), by means well known to a skilled artisan. Second end 216 is inserted into bushing 84 (FIG. 7), and in the preferred embodiment, pin 290 is inserted through hole 88 (FIG. 7) and a corresponding hole (not shown) in second end 216 to retain second end 216 in adopter 78. However, a skilled artisan would recognize a wide number of ways, from the disclosure herein, to pivotally interconnect second end 216 with first end 214.

Figure 16A:
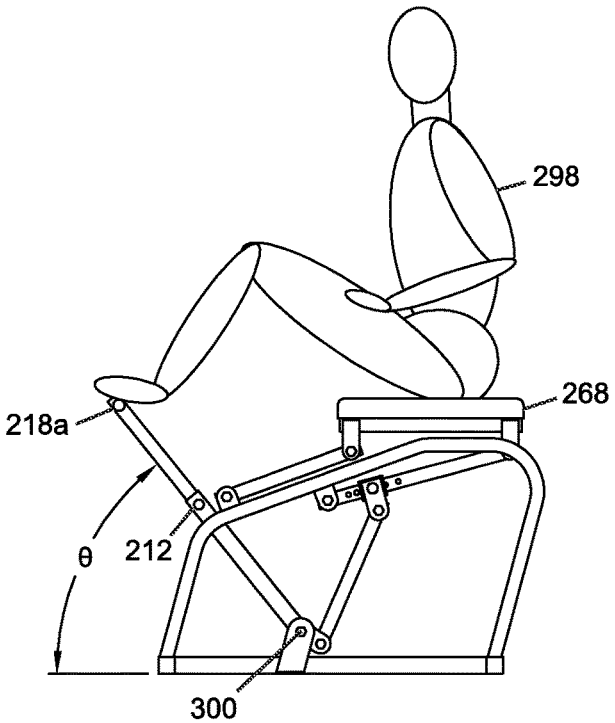
FIG. 16A and 16B show an exercise device configured for exercising the gluteus maximus muscles of a user.
Figure 16B:
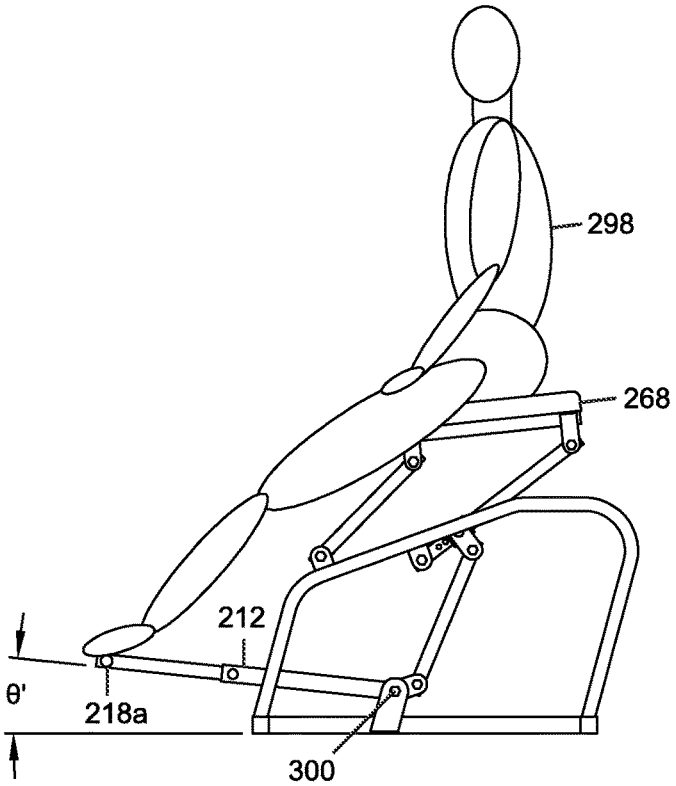

FIGS. 16A and 16B show an exemplary use of the device 210 for exercising the gluteus maximus muscles of user 298 seated on device 210. Referring to FIG. 16A, after first setting the exercise resistance as described above, user 298 places their feet on handles 218A and 218B (not shown), then as user 298 extends their legs, causing first lever 212 to rotate about first axis 300 (perpendicular to the plane of FIG. 16A) from angle θ to angle θ' shown in FIG. 16B, resistance force is generated by the body weight of user 298 as seat 268 raises to the position shown in FIG. 16B. The resistance force continues to be generated as user 298 reduces the force they are exerting on handles 218*a* and 218*b*, thereby returning to the starting position shown in FIG. 16A.

Figure 17A:
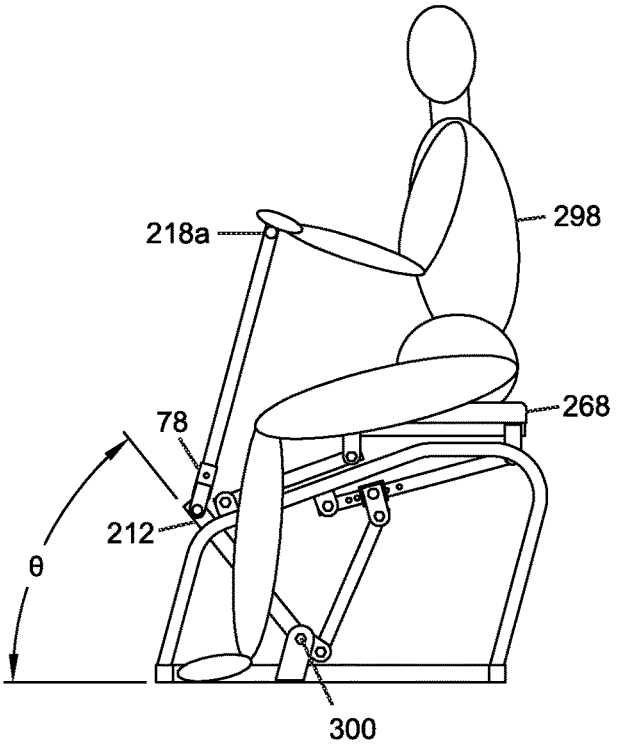
FIGS. 17A and 17B show an exercise device configured for exercising the abdominal muscles of a user.
Figure 17B:
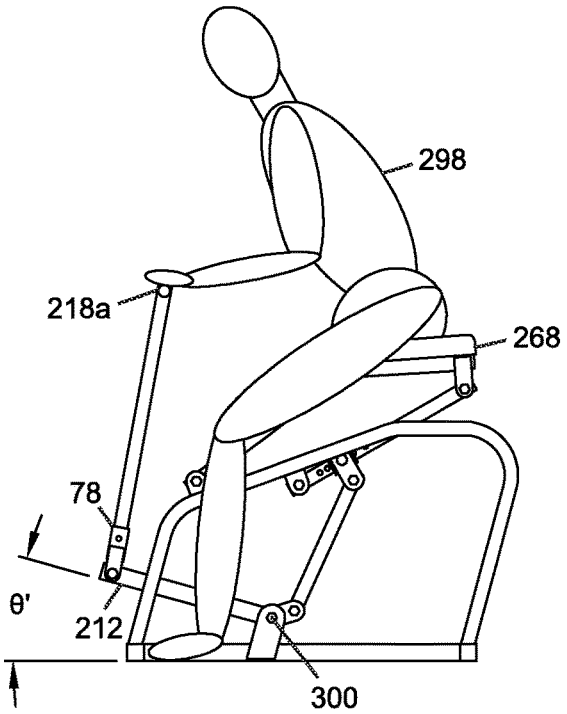

FIGS. 17A and 17B show a use of the device 210 for exercising the abdominal muscles of user 298 seated on device 210. Referring to FIG. 17A, after first setting the exercise resistance as described above, user 298 places their hands on handles 218A and 218B (not shown), then as user 298 rotates their upper body down, forcing handles 218A and 218B towards the floor, causing first lever 212 to rotate about first axis 300 (perpendicular to the plane of FIG. 17A) from angle θ to angle θ' shown in FIG. 17B, resistance force is generated by the body weight of user 298 as seat 268 raises to the position shown in FIG. 17B. The resistance force continues to be generated as user 298 reduces the force they are exerting on handles 218*a* and 218*b*, thereby returning to the starting position shown in FIG. 17A.

Figure 18A:
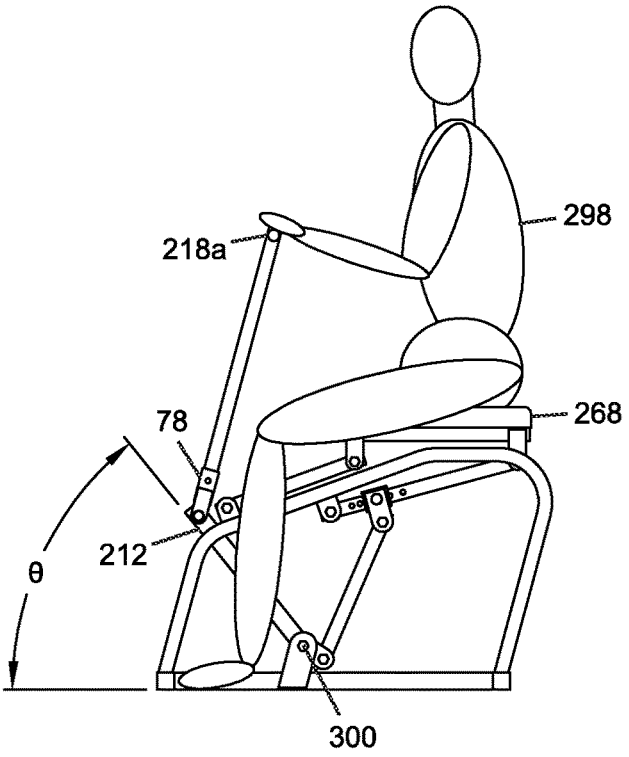
FIG. 18A and 18B show an exercise device configured for exercising the upper body muscles of a user.
Figure 18B:
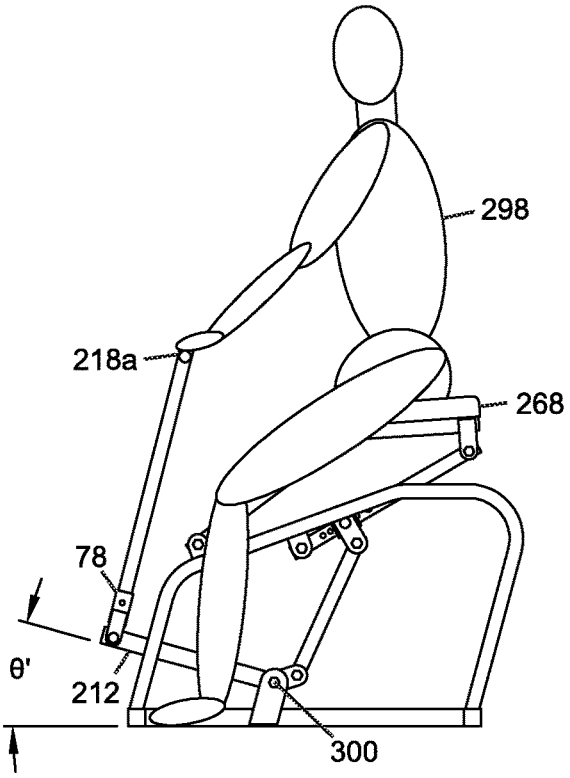

FIGS. 18A and 18B show a use of the device 210 for exercising the upper body and arm muscles of user 298 seated on device 210. Referring to FIG. 18A, after first setting the exercise resistance as described above, user 298 places their hands on handles 218A and 218B (not shown), then as user 298 pushes their hands down, causing first lever 212 to rotate about first axis 300 (perpendicular to the plane of FIG. 18A) from angle θ to angle θ' shown in FIG. 18B, resistance force is generated by the body weight of user 298 as seat 268 raises to the position shown in FIG. 18B. The resistance force continues to be generated as user 298 reduces the force they are exerting on handles 218*a* and 218*b*, thereby returning to the starting position shown in FIG. 18A.

Although the invention has been disclosed in its presently preferred and alternate embodiments, the invention is not intended to be limited thereby. Rather, a skilled artisan will recognize other combinations, omissions, substitutions, modifications and additions from the disclosure herein, including, without limitation, provision of equivalent, interchangeable or alternative embodiments which accomplishes substantially the same results as the disclosed embodiments, or constitutes an insubstantial change, that fall within the scope and spirit of the invention. Accordingly, the invention is to be defined by reference to the appended claims.

I claim:

1. An exercise device which comprises:

a. a frame;

b. a first lever having a first end and a second end with said first end being pivotally attached to said frame for rotation about a first axis relative thereto; a second lever having a first end and a second end with said first end being pivotally attached to said frame for rotation about a second axis relative thereto;

c. a connecting rod having a first end and a second end with said first end being pivotally attached to said first lever about a third axis relative thereto, and said second end being pivotally attached to said second lever about a fourth axis relative thereto; a first arm having a first end and a second end with said first end being pivotally attached to said frame about a fifth axis relative thereto;

d. a second arm having a first end and a second end with said first end being pivotally attached to said second end of said second lever about a sixth axis relative thereto, and said second end being pivotally attached to said second end of said first arm about a seventh axis relative thereto; whereby rotation of said first lever causes an upward movement of said second arm relative to said frame; and e. a slide assembly to selectively vary the distance between said fourth axis and said second axis.

2. An exercise device as recited in claim 1 wherein said second arm comprises a seat.

3. An exercise device as recited in claim 2 wherein the body weight of a user positioned on said seat established a resistance to rotation of said first lever.

4. An exercise device as recited in claim 3 wherein said resistance to rotation is proportional to the body weight of the user and the distance between said second axis and said fourth axis.

5. An exercise device recited in claim 1 further comprising a handle attached to said second end of said first lever.

6. An exercise device recited in claim 5 wherein said second end of said first lever is pivotally attached to said first end of said first lever.

7. An exercise device as recited in claim 1, wherein said first lever is adjustable.

8. An exercise device recited in claim 7 wherein said first lever is extensible to selectively vary the distance between said first end and said second end of said first lever.

9. An exercise device as recited in claim 1 wherein said slide assembly comprises: a bushing attached to a slider, said bushing having a surface dimensioned for mating engagement with said second lever; a plate fixedly attached to said slider and pivotally attached to said connecting rod about said fourth axis; and a lock pin for affixing said slide assembly to said second lever to selectively vary said distance between said fourth axis and said second axis.

10. A method of exercising muscles, the method comprising: positioning a user on a seat that is rotatively coupled to a frame by a first arm and a second lever; a first lever pivotally attached to said frame; and a connecting rod having a first end pivotally attached to said first lever and a second end pivotally attached to said second lever; whereby a force applied by the user against said first lever causes a rotation of said seat relative to said frame, wherein the position of said pivotal attachment of said connecting rod to said second lever is adjustable.

11. The method of claim 10, wherein said rotation of said seat establishes a resistance to rotation of said first lever.

12. The method of claim 11, wherein said resistance to rotation of said first lever is proportional to the body weight of said user and the position of said pivotal attachment of said connecting rod to said second lever.

13. The method of claim 10, wherein said pivotal attachment of said connecting rod to said second lever comprises a slide assembly.

14. The method of claim 13, wherein said slide assembly comprises: a bushing attached to a slider and slideably engaged with said second lever; a plate fixedly attached to said slider and pivotally attached to said connecting rod; and a lock pin for selectively affixing said slide assembly to said second lever.

15. The method of claim 10 further comprising a handle attached to the distal end of said first lever.

16. An exercise device which comprises: a first lever pivotally attached to a frame; a slide assembly engaged with a second lever for selectively positioning and affixing said slide assembly to said second lever at alternate positions, said second lever pivotally attached to said frame; a connecting rod interconnecting said first lever and said slide assembly about pivotal attachments; a first arm pivotally attached to said frame; and a seat pivotally attached to the distal ends of said second lever and said first arm; whereby the body weight of a user positioned on said seat establishes a resistance to rotation of said first lever.

17. An exercise device as recited in claim 16 further comprising a handle attached to the distal end of said first lever.

18. An exercise device as recited in claim 17 wherein said first lever is extensible to selectively vary the distance between said handle and said first lever's said pivotal attachment to said frame.

19. An exercise device as recited in claim 16 wherein said slide assembly has a surface dimensioned for slideable engagement with said second lever, and further comprising a lock pin to establish said affixing.

* * * * *